United States Patent [19]

Ichikawa et al.

[11] 3,946,592

[45] Mar. 30, 1976

[54] DIGITAL TIME ERROR MEASURING ARRANGEMENT

[75] Inventors: Shingo Ichikawa, Sayama; Hiroshi Yanagawa, Tanashi, both of Japan

[73] Assignee: Citizen Watch Company Limited, Tokyo, Japan

[22] Filed: Apr. 5, 1974

[21] Appl. No.: 458,375

[30] Foreign Application Priority Data

| | | |
|---|---|---|
| Apr. 9, 1973 | Japan | 48-40270 |
| May 31, 1973 | Japan | 48-60320 |
| July 13, 1973 | Japan | 48-79083 |

[52] U.S. Cl. ..... 73/6

[51] Int. Cl.[2] ..... G04D 7/12

[58] Field of Search ..... 73/6

[56] References Cited

UNITED STATES PATENTS

| | | | |
|---|---|---|---|
| 3,370,456 | 2/1968 | Jucker | 73/6 |
| 3,777,547 | 12/1973 | Izumi | 73/6 |
| 3,805,585 | 4/1974 | Palinkas | 73/6 |
| 3,811,314 | 5/1974 | Anouchi | 73/6 |

*Primary Examiner*—S. Clement Swisher

*Attorney, Agent, or Firm*—Sughrue, Rothwell, Mion, Zinn & Macpeak

[57] ABSTRACT

The invention resides in an improved time error measuring device or test bench for watches. The device includes a sensing microphone for sensing the stepping movement of the watch under test and in the form of a series of electric signal pulses. It further includes a range selector adapted for selecting a proper range depending upon the thus sensed stepping signal pulse series. Time error measuring means is utilized for detecting occasional time error of the watch by comparing the sensed stepping pulses with a standard clock pulse series and at the precision attributed to a selected measuring range. All these operations may be carried out in a fully automatic manner.

11 Claims, 8 Drawing Figures

1
COUNTER SECTION
GATE SIGNAL GENERATOR SECTION
2
GATE SELECTOR SECTION
3
COUNT STOP GATE BLOCK
4
RANGE SELECTOR SECTION
5
LATCH CIRCUIT SECTION
6
DECIMAL DECORDER SECTION
7
TIME ERROR DISPLAY SECTION
8
STANDARD CLOCK PULSE INPUT
R
UD
PS
CL
CE
TOR
WS
FF9(Q̄)
FF9(Q)
G1
G2
G3
GO1
GO2
GO3
FF1
FF2
FF3
FF4
FF5
FF6
FF7
FF8
FF9
NG1
NG2
NG3
NG4
NG5
NG6
NG7
NG8
NG9
NG10
NG11
NG12
NG13
NG14
NG15
NG16
NG17
IV1
IV2
IV3
IV4
IV5
IV6
IV7
OG1
OG2
OG3
MM1
MM2
MM3

DIGITAL TIME ERROR MEASURING ARRANGEMENT

BACKGROUND OF THE INVENTION

This invention relates to a digital type time error measuring device for watches.

With conventional digital type time error measuring devices, manual selective operations must be carried out, so as to adapt them for optimum measuring accuracy which varies depending upon the type of the watch and the stepping or the like operating frequency.

It should be mentioned at this stage of description that the term "stepping" which is best applied to mechanical watches will be used also in reference to semi- or pure electronic watches.

There are generally three categories of watches. The first one is the traditional mechanical watch. The second one is the electro-mechanical watch, such as electromagnetically vibration or oscillation-sustaining tuning fork or drive balance wheel type, pulse motor-driven. The third one is the purely electronic and digital time display type.

When a watch is tested on a test bed for detecting the occasional time display error thereof, the stepping information of the watch must be derived for comparison with a standard clock pulse information developed and maintained by a separate generating source, such as a quartz oscillator built-in in the test bed.

In the case of a mechanical watch placed on the test bed the stepping movement of the balance wheel can be sensed by a mechanical sensor such as a bar feeler which is kept in contact with the watch case, and then converted into a corresponding electrical pulse series through a piezoelectric element mounted on the feeler.

In the case of a semi-electronic watch of tuning fork type as an example, being placed on the test bed, the required stepping information of the watch can be derived from drive coil means thereof and in the form of a stepping-responsive stray magnetic information which may converted into a corresponding electrical pulse series preferably by a sensing coil provided in the test bed.

Even if the watch is of the pulse motor drive type, the stepping-responsive magnetic information can equally be derived from the drive coil of the motor.

In the case of a pure electronic watch placed on the test bed, the required stepping-responsive information can be derived from the digital display electrode means and in the form of a periodically variable stray electrical field which can be converted into a corresponding electric pulse series by means of a sensing electrode provided in the test bed and acting as a counter electrode relative to said display electrode means, constituting thereby a capacitor in combination.

The aforementioned three categories of the watch correspond substantially to the stepping precision from low, for mechanical movements to high for electronic ones. Therefore, for carrying out measurements of time errors of watches, these watches must optimumly be classified into specific classes of measuring ranges. For this purpose, manual change-over manipulations have been carried out in use of the conventional test bed to adopt and select a most proper measuring range among various ranges provided in the test bed.

SUMMARY OF THE INVENTION

It is, therefore, the main object of the present invention to provide an improved time error measuring device, capable of obviating the aforementioned troublesome manual change-over job for proper range selection and highly adapted for the realization of a full-automatic device of the above kind.

The time error measuring device for watches, according to this invention, is characterized by the provision of means for the automatic determination of the proper measuring range of a watch under test, depending upon the inherent stepping precision degree thereof and adapted for successive measurement of occasional time error of the watch within the predetermined range and in comparison with a standard clock pulse series.

These and further objects, features and advantages of the present invention will become more apparent when read the following detailed description of the invention by reference to the accompanying drawings illustrative of several preferred embodiments of the invention

BRIEF DESCRIPTION OF THE DRAWINGS

In the drawings:

Referring now to FIG. 1, illustrating a watch signal detecting miorophone-like unit, generally shown at 12, numeral 13 represents a box-shaped casing which comprises an upper cover or table is denoted as 14. This table 14 is formed with a small opening **14*a* in which a shock-absorbing sleeve 15** made preferably of rubber is attached fixedly.

Figure 1:
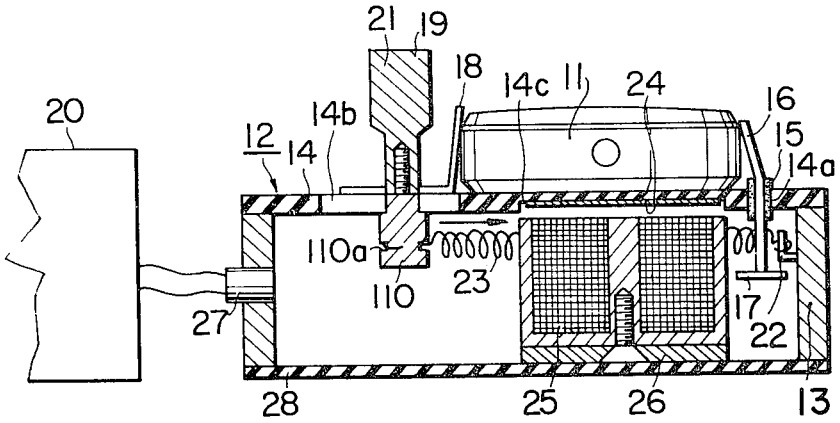
FIG. 1 is a substantially sectional view of a sensing microphone adopted in this invention.

A vibration detector bar 16 is fixedly mounted in this sleeve 15 and extends considerably therefrom upwardly and downwardly. At the lowermost end of the downwardly extending portion of said bar which is positioned within the interior space of said unit 12, there is provided a piezo-electric element 17 glued to the bar.

A rigid, angle-shaped positioning member 18 substantially covers a slot window opening **14*b* formed through the table 14 and slidably mounted thereon. A knob piece 19 is fixedly attached substantially at its lower end to the positioning member 18, an attachment piece 110 being coupled rigidly from below to the knob piece by screwing as shown. In this way, a slide assembly 21 is constituted by these members 18, 19 and 110. The piece 110 is formed with a circular groove 110*a* for mounting one end of a tension spring 23, the opposite end of which is fixed to a hook 22 positioned on the inside wall 23 of said casing 13. Therefore, the slide assembly 21** is subjected always to a resilient force directing rightwards in FIG. 1, as shown by a small arrow.

There is provided a recessed area 14c on the lower surface of table 14 on which an electrode plate 24 is fixedly attached as by gluing and for stray field detection. Below the electrode plate 24, there is provided a coil 25 mounted on a support 26 for detecting stray magnetic field, as will be more fully described hereinafter. The coil support 26 is rigidly mounted on the bottom plate 28 of said casing 13.

An electric connector 27 is mounted in the casing 13 and connected electrically in parallel with the electrodes of piezo-electric member 17 and the both ends of coil 25, not shown.

The watch 11 to be measured is placed on table 14 and positioned between the vibration detector 16 and the slide 18 and subjected to spring tension at 23.

When the watch 11 has a mechanical movement, the mechanical vibration which corresponds precisely to its stepping motion is transmitted mechanically to the detector 16 now kept in pressure contact with the watch as shown. The thus transmitted mechanical vibration is converted into a corresponding voltage pulse variation which is further transmitted through connector 27 to watch signal selector section 20.

If the watch is an electronic watch which is provided with an electromagnetic converter for driving a pulse motor, a variable stray magnetic field in synchronism with rotation of the rotor will be emanated from the watch and detected in and by the coil 25. The detected variable stray magnetic field is converted in the coil 25 into corresponding voltage variation which is further transmitted to watch signal selector section 20 as before.

If the watch 11 is an electronic and digital type one, stray electrical field will emanate from the watch and is caught by the electrode plate 24 which converts the variable field into corresponding voltage pulse fluctuation, and the latter is further conveyed through connector 27 again to the selector block 20.

Figure 2:
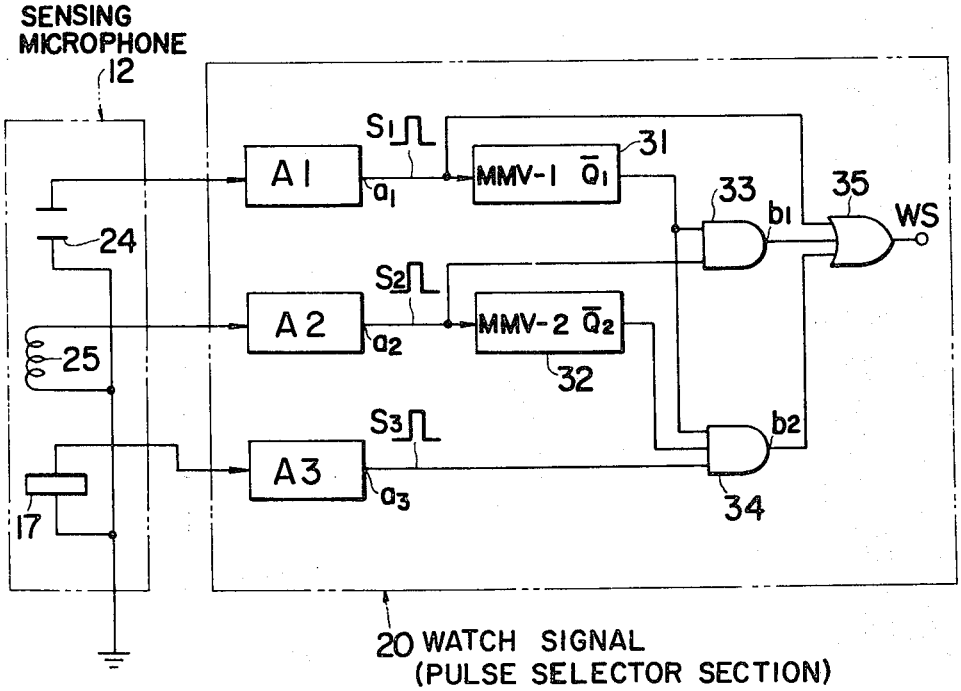
FIG. 2 is a block diagram showing a combination of a clock pulse selector with said sensing microphone.

In FIG. 2, the watch signal selector is schematically shown.

Numeral 12 represents again the sensing microphone which comprises the aforementioned several sensing elements 17, 24 and 25 same as before.

A1, A2 and A3 represent shaping amplifiers which are connected respectively with output ends of these sensing elements 24, 25 and 17.

At the output $a_1$ of the shaping amplifier A1, a series of pulses as at $S_1$ will appear as representing the stray field signal sensed at the electrode plate 24 and in a shaped and amplified form.

At the output $a_2$ of the shaping amplifier A2, a series of pulses as at $S_2$ will appear as representing the stray magnetic field signal sensed at the coil 25 and in a shaped and amplified form.

At the output $a_3$, a series of pulses as at $S_3$ will appear as representing the mechanical vibration signal sensed at the piezo-electric element 17 and in a shaped and amplified form.

Numerals 31 and 32 represent respective monostable multivibrators, abbreviated as MMV-1 and MMV-2, respectively.

These multivibrators 31 and 32 are triggered and retriggered by application of the pulse series $S_1$ and $S_2$, respectively.

Output signal from the output at $\overline{Q1}$ of multivibrator 31 is fed to an input of AND-gate 33. Output signal from the output $a_2$ of amplifier A2 is fed to a further input of the same AND-gate 33. The signal $S_2$ may selectively appear at the output $b_1$ of AND-gate 33 depending upon the conditions at $\overline{Q1}$.

Output signal from the output at $\overline{Q1}$ of multivibrator 31 is fed also to an input of AND-gate 34. Output signal from the output $\overline{Q2}$ of multivibrator 32 is fed to a further input of AND-gate 34. Output signal $S_3$ at output $a_3$ of amplifier A3 is fed to a still further input of AND-gate 34.

At the output $b_2$ of AND-gate 34, the signal $S_3$ may appear selectively, depending upon the conditions at the outputs $\overline{Q1}$ and $\overline{Q2}$. Outputs $a_1$, $b_1$ and $b_2$ are connected to respective inputs of OR-gate 35.

As may be well appreciated two or more kinds of input signals can be fed to the block 20. However, in this case, a preference in the order of electrical field signal, magnetic signal and mechanical vibration signal is established in the block 20, and thus, only one kind input signal will be delivered substance through output terminal WS connected to the output of OR-gate 35 shown in FIG. 2, as will be more fully described below with reference to FIGS. 3 and 4.

Figure 3:
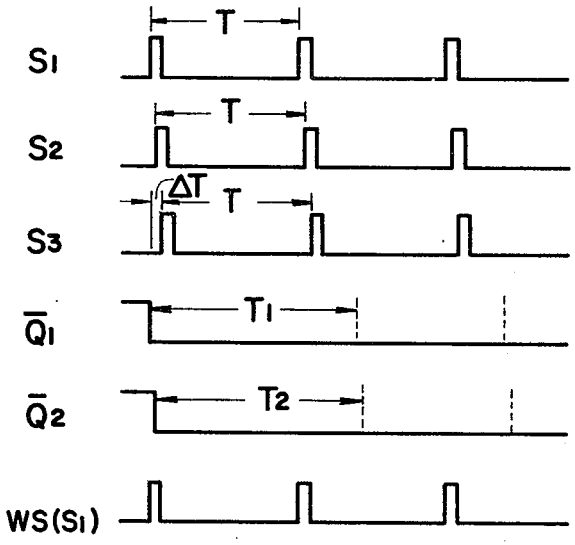
FIG. 3 and 4 are two wave from charts showing several voltage pulses appearing at several preferred points of the combined circuit shown in FIG. 2 and at two different operational stages, respectively.
Figure 4:
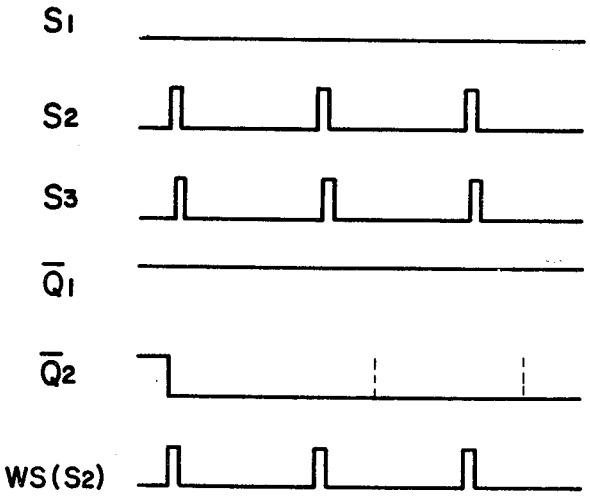

Now it is assumed that three kinds of input and processed pulse signals $S_1$, $S_2$ and $S_3$, emanating from the watch 11 under test and having thus a common period T, should appear at $a_1$, $a_2$ and $a_3$, respectively and substantially at the same time as shown in FIG. 3, and that $\Delta T$ represents a maximum time lag between one of the first kind pulse series, for example $S_1$ and the third pulse signal series, $S_3$.

$T_1$ represents the specifically designed operation period of monostable multivibrator (MMV-1) 31, as determined by and between the application of an input pulse $S_1$, thereby converting its state from logic 1 to 0, and the termination of the thus converted state to recover its normal state 1. In the similar way, $T_2$ represents the specifically designed operation period of monostable multivibrator (MMV-2) 32, as determined by and between the application of an input pulse $S_2$, thereby converting its state again from logic 1 to 0, and the termination of the thus converted state to recover its normal state 1.

Now assuming such condition: $(T + \Delta T) < T_1$ which is nearly equal to $T_2$, both outputs $\overline{Q1}$ and $\overline{Q2}$ of multivibrators 31 and 32 are kept their high level or logical 1 if there is no input watch signal pulse applied to the sensing microphone 12. Thus, AND-gates 33 and 34 are ready for passage of signal pulses $S_2$ and $S_3$, respectively, if applied. On the other hand, signal pulse $S_1$, if applied, it can always be passed to the OR-gate 35. Since the outputs $b_1$ and $b_2$ are permanently connected with respective inputs of OR-gate 35, any one of said watch pulses $S_1$, $S_2$ and $S_3$ is applied solely to the microphone, it may appear without hindrance at the final stage output terminal WS in FIG. 2, under these operating conditions.

When said three kinds watch pulses $S_1$, $S_2$ and $S_3$ are applied substantially simultaneously as above mentioned, multivibrator 31 will be triggered with the watch pulse $S_1$ and thus convert its state from logical 1 to 0, so as to close AND-gates 33 and 34, preventing watch pulses $S_2$ and $S_3$ from being transmitted. Therefore, watch pulse $S_1$ can only appear at the output terminal WS. Before termination of the operating period $T_1$, the following $S_1$-pulse is applied, thereby multivibrator 31 is retriggered for maintaining the zero logic state. During continued application of $S_1$-pulses, therefore, other $S_2$- and $S_3$- pulses are positively prevented from appearing at the output terminal WS, FIG. 2. Therefore, a part of the aforementioned estabtishment for job preference will be executed.

Even in such a specific timing these three types watch pulses $S_1$, $S_2$ and $S_3$, where $S_2$ or $S_3$ should lead relative to $S_1$, the first watch pulse can appear at the output WS, yet second and further pulses $S_2$ or $S_3$ can be effectively checked from appearing at WS, thus completing the preference sequence.

Now considering a case that $S_2$- and $S_3$ pulse series are concurrently applied to the sensing microphone 12 from the watch 11. By the application of a $S_2$-pulse, multivibrator 32 turns from its logic 1 to 0 state, thereby AND-gate 34 is closed, so as to check passage of $S_3$-pulses. Multivibrator 31 is not activated with $S_1$-pulses. Therefore, the remaining $S_2$-pulses will pass through AND-gate 33 and OR-gate 35 to output terminal WS.

It is clear from the foregoing that even if any combination of said three kinds watch pulses $S_1$, $S_2$ and $S_3$ is applied at the microphone 12, only one selected kind pulse series is allowed to pass through the block 20 to be taken out at the output terminal WS, according to the established preference order.

It should be noted that the number of the kinds of the watch signal pulse series is not limited only to three. If necessary, the number could be increased to four or more numerous series of pules.

It is further clear from the foregoing embodiment and for covering every possible kinds of the watches to be tested upon, it will suffice to pre set the operation periods $T_1$ and $T_2$ of the multivibrators 31 and 32 in consideration of a least possible stepping frequency of the watches, say, that of the mechanical watch. The necessary condition, therefore, can be expressed as:

$$(T + \Delta T)_{max.} < T1 \div T2$$

At the present developed stage of the watch industry, the value of $T_1$ or $T_2$ is approximately 1.5 seconds, in consideration of Tmax. being approximately one second for the pulse motor drive electronic watch.

Although in the embodiment shown in FIG. 1, the clock or watch signal pulse selector 20 has been shown as a separate block from the sensing microphone 12, both units can be physically coupled into one by arranging the selector block 20 within the casing 13 of the microphone. In addition, the circuit block shown in FIG. 5 (to be discussed herein) may conveniently be incorporated into an overall unified block, so as to provide an automatic time error measuring device.

Further it should be noted that each the watch signal pulse sensing elements 17, 24 and 25 may be designed as any desired kind of watch stepping information detector element in its broadest sense, although not specifically shown and described.

Figure 5:
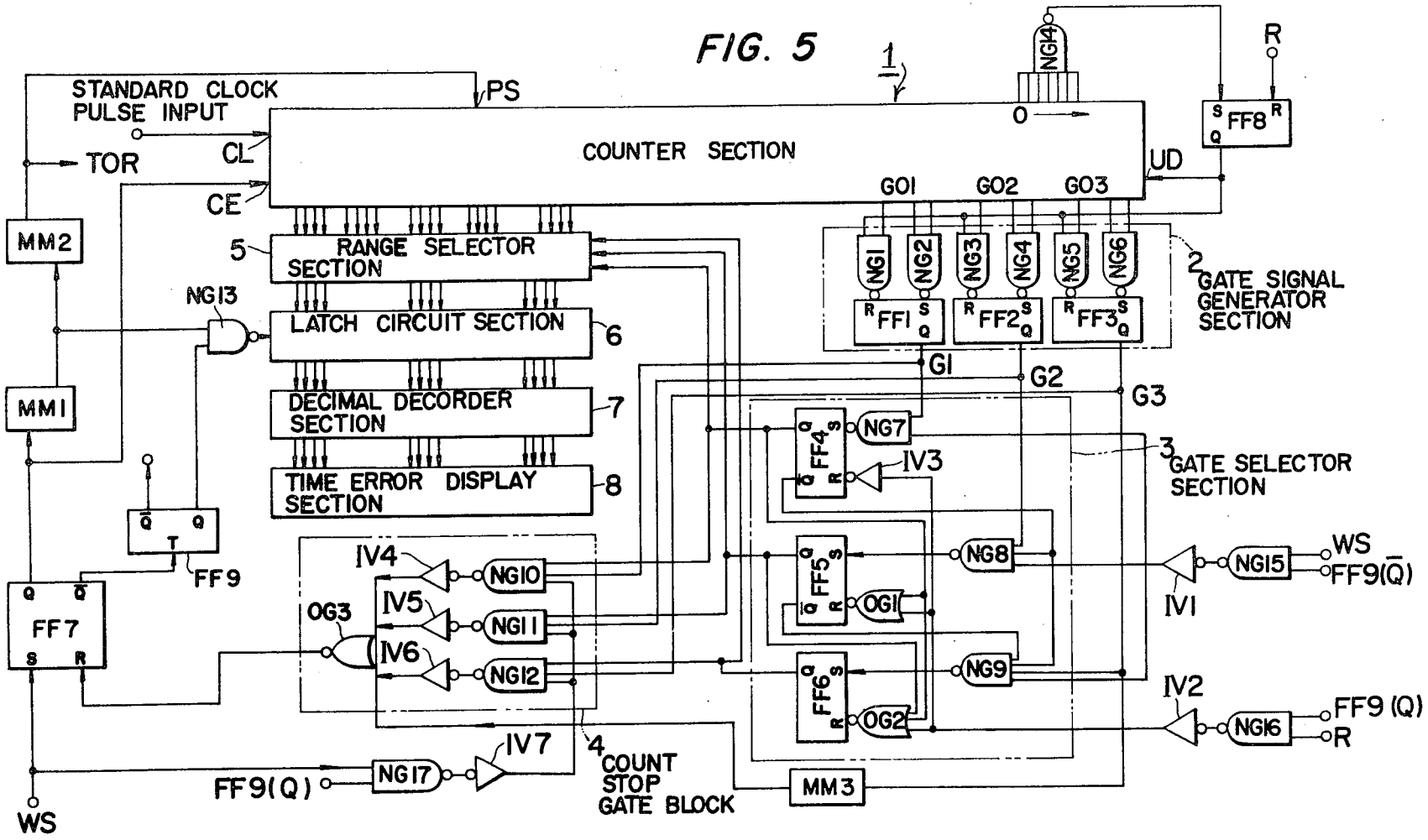
FIG. 5 is a schematic block diagram of essential parts of a preferred embodiment of the present invention.

Referring now to FIG. 5, showing the first embodiment of the invention, NG1 . . . NG17 represent respective NAND-gates; OG1 . . . . . OG3 respective NOR-gates; FF1 . . . . FF8 RS-flip-flops; FF9 represents a T-flip-flop; and MM1 . . . MM3 represent respective monostable multivibrators. IV1 . . . IV7 represent respective inverters.

Numeral 1 represents a counter section, which is preferably a 7-units reversible electronic decimal counter, while numeral 2 represents a gate signal generator section adapted for generating a plurality of, herein three, different kinds of gate signals having specifically designed different duration periods, as will be more specifically described hereinafter. This gate signal generator section comprises electronic constituents NG1 . . . NG6 and FF1 . . . FF3.

Numeral 3 represents a gate selector section which is adapted for selection of a proper one of the gates included in a count-stop gate section 4, responsive to the gate signal received and the watch pulse signal fed through an input terminal WS. The section 4 serves as an on-off control of stop pulses, as will be more fully described hereinafter. The gate selector section 3 comprises said electronic constituents NG . . . NG9, OG1 and OG2, FF4 . . . FF6 and IV3. The count-stop gate section 4 comprises NG10 . . . NG12, 6G3, IV4 . . . IV6.

Numeral 5 represents a range selector section which selects a proper stepping measuring range, depending upon the gate signal received.

Numeral 6 represents a latch circuit section which serves for data exchange exclusively during the main measuring stage to be described. Numeral 7 represents a 3-units decimal decorder and numeral 8 shows a digital time error display section comprising a 3-units display elements group. The watch pulse input WS is shown at two different places in FIG. 5 only for convenience.

The aforementioned constituents are electrically connected, as clearly illustrated in FIG. 5.

Figure 6:
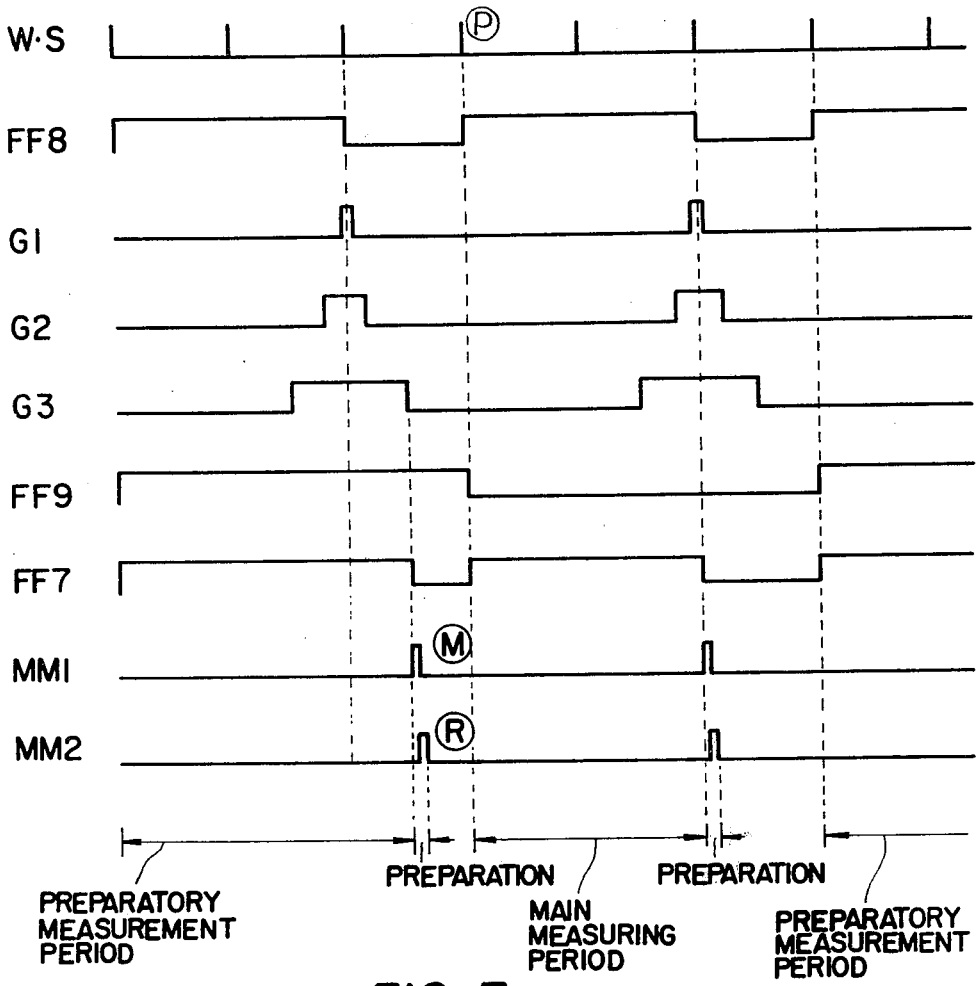
FIG. 6 is a timing chart of the voltage signals appearing at several preferred points of the circuit shown in FIG. 5.

In FIG. 6, a number of different voltage curves appearing at several points in the arrangement shown in FIG. 5 are shown. It should be stressed that the gate signals G1, G2 and G3 have been illustrated in a rather exaggerated way for more clear understanding of the present invention.

The measuring operation is divided into the preparatory measuring stage and the main measuring stage and the former will be described below at first.

As an example, a predetermined 7-units decimal number such as 8640000 has been preset in the counter section 1. It is assumed that $\overline{Q}$-output terminal (shown twice in FIG. 5) of the flip-flop FF9 is off while Q-output terminal (shown again twice in FIG. 5) thereof is on.

Under these conditions, when a series of watch pulses (as shown at WS in FIG. 6) is applied from a supply source 20, FIG. 2, through input terminal WS to flip-flop FF7, the latter will be set at the arrival of the first pulse of said series and thus, the Q-output terminal thereof switches from off to on. In this way, count-enabling terminal CE of the counter section 1 is fed with a setting signal for bring the latter into its substracting operation mode for substracting standard clock pulses, say 86400 Hz $\times n$, n being an integer which may be say 100 as adopted herein, from the once preset value 8640000 as referred to above. The standard clock pulsess are supplied through an inlet terminal CL to the counter 1. The standard clock pulse supply source may be of a conventional design, such as a quartz oscillator which is electrically connected with the input terminal CL although not shown as being well known the in the art.

The counter 1 is provided with the NAND-gate NG14 which is designed to deliver an output signal when the contents of the counter 1 becomes zero which condition will be established when the initially preset value 8640000 has been substracted out. With arrival of the output signal it's S-input, flip-flop FF8 reverses its state, say, from logic 0 to 1, and an output signal is delivered thereby from its Q-output terminal to a UD (up-down) terminal of the counter 1, thereby the latter converting its operational mode from substraction to addition.

The counter 1 has first, second and third output GO1, GO2 and GO3 for delivery of respective timing pulse signals. The first output GO1 is connected with inputs of NAND-gates NG1 and NG2. The second output GO2 is connected with inputs of NAND-gates NG3 and NG4. In the similar way, the third output GO3 is connected with inputs of NAND-gates NG5 and NG6.

Q-output of flip-flop FF8 is connected permanently to an input of each of said NAND-gates NG1, NG3 and NG5, as shown.

When the contents of the counter 1 represent +0000999 which corresponds to a daily time lead 9.99 seconds of the watch under test; not shown, an output signal will be delivered from the first output GO1 to NAND-gate NG2 which is thus energized or opened to deliver an output signal to S-input of flip-flop FF1 to convert its state, thereby its Q-output converting from logic 0 to 1. When the contents of the counter 1 represent 0000999 which corresponds to a daily time lag of 9.99 seconds of the watch under test, an output pulse signal will be delivered from the first output GO1 to NAND-gate NG1 which is thus energized to deliver an output signal to R-input of Flip-flop FF1 to convert its state, thereby its Q-output converting from logic 1 to 0.

In the similar way, when the contents of the counter 1 represent + or − 0009990 which corresponds to a daily time lead or lag 99.9 seconds, an output signal will be delivered through second output GO2 and NAND-gate NG4 or NG3 is energized and flip-flop FF2 operates.

In the similar way, when the contents of the counter 1 represent + or − 0099900 which corresponds to a daily time lead or lag 999 seconds, an output signal will be delivered through third output GO2 and NAND-gate 6 or 5 is energed and flip-flop FF3 operates.

The gate selector section 3 comprises NAND-gates NG7, NG8 and NG9 and flip-flops FF4, FF5 and FF6, as shown. These NAND-gates NG7, NG8 and NG9 are adapted for detection coincidence of the gate signals G1, G2 and G3 coming from the gate signal generator 2 with the watch signal pulse at WS passed through preparatory gate NG15, while said flip-flops FF4, FF5 and FF6 are adapted for memory of thus selected-out optimum gate for the measurement and as determined by the presence of the said coincidence, if any.

The preparatory selection step at the gate selector 3 for the determination of a proper gate will now be described by reference to FIGS. 5 and 7.

In the case of the preparatory measuring stage under consideration, output $\overline{Q}$ of flip-flop FF9 is kept on and the watch pulse signal at WS is applied through NAND-gate NG15 to one side inputs of NAND-gates NG7, NG8 and NG9, respectively.

On the other hand, gate pulses G1, G2 and G3 from gate signal generator 2 are applied to other side inputs of NAND-gates NG7, NG8 and NG9.

Now, it is assumed that flip-flops FF4, FF5 and FF6 have been reset upon application of reset pulse from terminal R so that outputs $\overline{Q}$ of these flip-flops are all kept on. Under these conditions, only such pulse or pulses from RS kept in synchronism with the related gate pulses with said NAND-gates NG7, NG8 and NG9 is/are allowed to pass, so as to set the flip-flops FF4, FF5 and FF6 which are connected with respective outputs thereof.

Figure 7:
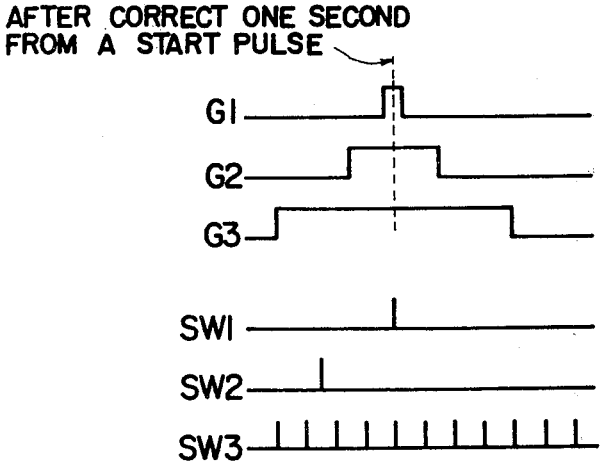
FIG. 7 is an enlarged chart substantially showing a part of FIG. 6.

In FIG. 7, G1, G2 and G3 represent three different duration gate signals brought into coincidence with each other. SW1 is assumed to represent a watch signal which has a low frequency and a high time precision. SW2 is assumed to represent a watch signal which has a low frequency and a low time precision. SW3 is assumed to represent a watch signal which has a high frequency and a high time precision. All these watch signals are fed through the terminal WS.

With supply of the watch signal SW1, and in the counter 1 which has started already to initiate the substracting operation by supply of the foregoing start pulse as was referred to hereinbefore gate pulses G3, G2 and G1 will be caused to apply in succession of the order and in a predetermined standard time point as shown by a dotted vertical line in FIG. 7, and then caused to close upon lapse of the zero result in the counter 1. During this operation, only one pulse of the pulse series SW1 will pass through these three gates during their opened state, thereby all the three flip-flops FF4, FF5 and FF6 being brought into their set state. However, two (FF5 and FF6) of these flip-flops are reset by the output signal at Q of the remaining one FF4 fed through OR-gates OG1 and OG2, while the flip-flop FF4 is maintained, Therefore, with supply of the pulse series SW1, measurement can be executed in any of the measuring ranges. However, in practice and in this example, on account of the high time precision the gate G1 for highest measurement range of ± 9.99 sec/day will be selected out.

With application of watch signal SW2, as shown in FIG. 7, the watch signal is allowed to pass during the conducting period of NG9, and only flip-flop FF6 is set through NG9. While, during the conducting period at G1 and G2, there is no watch signal and thus, flip-flops FF4 and FF5 are not set. Therefore, in this case, gate G3 for the most rough precision measuring range, ± 999 sec/day is selected out.

With application of the watch signal SW3, as shown in FIG. 7, flip-flop FF6 will be set with the watch signal upon opening of the gate G3, and flip-flop FF5 will be set upon opening the gate G2. However, since flip-flop FF6 is reset by the output signal at Q-output of flip-flop FF5 through OR-gate OG2 and NAND-gate NG9 is caused to close by the output signal at $\overline{Q}$ of the same flip-flop FF5, further application of the watch pulses can not set the flip-flop FF6. In the similar way, when gate G1 is opened to set flip-flop FF4, its output signal at Q thereof will reset the flip-flops FF5 and FF6, while NAND-gates NG8 and NG9 are caused to close by the application of output signal at G of flip-flop FF4, thereby the latter only being selected out.

The aforementioned gate selecting operation terminates at the termination of G3-pulse, FIG. 6, by which the flip-flop FF3 is reset and the output signal at Q thereof will cause at its go-down to off the multivibrator MM3 to operate, so as to deliver therefrom a termination pulse which is fed through OR-gate OG3 to flip-flop FF7 to reset. By this operation, an optimum one of the flip-flops FF4, FF5 and FF6 is selected out for the most suitable gate.

In this case, outputs from Q-outputs of the flip-flops FF4, FF5 and FF6 in combination with respective gate pulses G1, G2, and G3, FIGS. 6 and 7, condition the count stop gate 4 adapted for the main measuring operation and cause the section 5 to operate depending upon the selected-out gate for setting a most proper measuring range.

The preparatory measuring stage has now been completed. Next, the main measuring stage will be described with reference to the watch signal shown in FIG. 7.

In the foregoing preparatory measuring stage, the flip-flop FF4 has only been set and the section 5 has been changed over to the measuring range of ± 9.99 sec/day. In the section 4, the NAND-gate NG10 only has been set.

Under these operating conditions, when flip-flop FF7 is reset by application of output signal from said multivibrator MM3, output from the same flip-flop FF7 will turn off at its Q-output and on at its Q-output, and the CE-terminal of the section 1 is reset, so as to terminate the counting job. At the termination of $\overline{Q}$-output signal from flip-flop FF7, the multivibrator MM1 will generate a latch pulse (M) as shown in FIG. 6. However, NAND-gate 13 is kept closed by virtue of the off output state at Q of flip-flop FF9. Therefore, a latch operation can not be started in any way. The time error display section 8 which may be composed of a combination of a plurality of, say three, conventional digit display tubes such "MIXY" as most frequently used in electronic calculators, although not shown, will continue to hold the foregoing time error data.

At the up-rising leading edge of the latch pulse (M), FIG. 6, multivibrator MM2 will operate so as to develop a reset pulse (R), FIG. 6, thereby the aforementioned presetting date: 8640000 is introduced in the counter section 1. At the same time, flip-flop FF8 is reset, thereby the operation of the same section 1 being change over to a substraction stage.

Although the reset pulse (R) is applied to the input of NAND-gate NG16, the gate selector 3 is not reset on account of output failure at Q of the flip-flop FF9.

At this stage, preparating operations for the main measuring job have been completed. The duration time counted from the completion of the preparatory stagee to the above termination of the preparing operations for the main measuring stage will extend for less than 100 nano-seconds which are negligibly small relative to the stepping period of the watch 11 under test for time error.

Next, the main measuring job will be described below in detail.

In FIG. 6, the fourth pulse at "P" of the watch pulse series WS is assumed to be a start pulse to be supplied as the first one upon completion of the preparating operations for the main measuring job and supplied to flip-flop FF7, so as to set CE-inlet of the counter section 1 which initiates thus a substracting job as before. At the same time, the output at $\overline{Q}$ of flip-flop FF7 represents a descending leading edge by which the flip-flop FF9 turns its state so that its output Q becomes on while its output $\overline{Q}$ becomes off, thereby the measuring conditions being changed over from the preparatory to the main measuring stage.

When the subtracting operation in the section 1 continuous nearly for a correct standard time, 1 second adopted herein, the gates different duration gate pulses as at G3, G2 and G1, FIGS. 6 and 7, develop in this order, as was referred to hereinbefore, and are applied to the gates contained in the section 4. Since, in the foregoing stage, only the flip-flop FF4 in the selector 3 has been set, NAND-gate 10 only is opened for the duration term of a gate pulse G1, during which the watch pulse WS arriving through NAND-gate NG17 is allowed to pass as a stop pulse, so as to reset the flip-flop FF7, thereby the CE-input of the counter 1 being reset for the termination of the counting job. At the same time and with the arrival of the descending edge of Q-output of the flip-flop FF7, the multivibrator MM1 will be caused to operate for passing a latch pulse (M) through gate NG15 which is kept open exclusively during the main measuring stage and by means of the flip-flop FF9 and for allowing the operation of the latch circuit 6.

By this operation, a three units numeral of all the new data concerning the stepping motion of the watch 11 which are written-in in the section 1 and as specified by the change-over section 5, is taken out from the same section and conveyed through decimal decorder 7 to time error display section 8.

Figure 8:
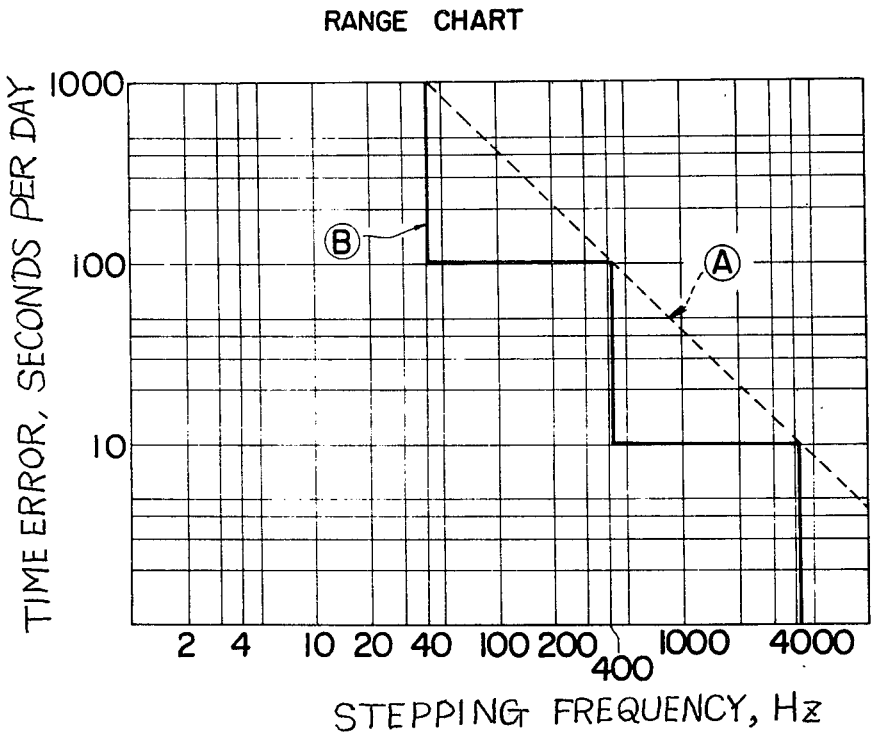
FIG. 8 is a logarithmic chart showing a measuring range allocation as adopted in the above embodiment.

In the chart shown in FIG. 8, the measurable ranges with use of the device according to this invention and concerning the stepping frequency and time accuracy belong to the area below a dotted line A shown therein. In the present embodiment, by properly conditioning said gates G1, G2 and G3, the ranges can be defined by a broken full line B and on the area therebelow, as shown. For a watch, having its operating frequency of 43 Hz at the maximum, measurements can be made till the time accuracy of ± 999 sec./day. For 430 Hz, measurements can be made till the time accuracy of ± 99.9 sec./day. For 4.3 kHz, measurements can be made till the time accuracy of ± 9.99 sec./day, according to our practical experiments.

Generally speaking, when the higher the operational frequency is, then the higher will be the time accuracy of the watch. Therefore, it can be concluded that the aforementioned measuring ranges will satisfy the practical demands.

For the time piece, such as the quarz oscillator type pulse motor-driven watch wherein the operating frequency is low, yet the time accuracy is high, a properly selected range can be established well adapted for the desired measuring purpose, as was explained specifically hereinbefore.

In the foregoing description, the preparatory and main measuring jobs were carried out in the series mode by use of a single counter section. However, in practice, they can be executed simultaneously and in a parallel manner by use of a pair of counter sections, although not specifically shown.

The embodiments of the invention in which an exclusive property or privilege is claimed are as follows:

1. A digital time error measuring device, comprising in combination, a) first means for sensing a watch signal from a watch under test; b) second means for amplifying said watch signal and converting it tinto pulses; c) a standard oscillator for generating a series of standard clock pulses; d) a preliminary measuring means adapted for operation by reception of said standard clock pulses for selecting and determining the most optimal respective one of predetermined measuring and displaying conditions and depending upon the difference between the frequency of said clock signal and the measured watch signal; e) main measuring means for measurement of time error of said watch signal and depending upon the measuring conditions selected and determined by said preliminary measuring means; and f) time error display means for display of measured results by main measuring means and depending upon the display condition selected and determined by said preliminary measuring means, wherein said first means for sensing a watch signal comprises sensing means for watch signals of a different physical nature comprising periodic stepping information of electrical field, magnetic field and mechanical vibration modes.

2. The device of claim 1 wherein said sensing means is a microphone comprising said sensing elements arranged within a casing, these sensing elements being arranged in parallel to said signal-treating means for being kept always in their active condition.

3. The device of claim 2 further comprising watch signal selector means adapted for selection of higher order signal among the watch signals delivered from said sensing means and in accordance with a preferential order as determined by the kind of said physical nature of the watch signal.

4. The device of claim 3 wherein said preferential order is determined by the order of electrical field, magnetic field and mechanical vibration mode, in succession.

5. A digital time error measuring device, comprising in combination, a) first means for sensing a watch signal from a watch under test;

b. second means for amplifying said watch signal and converting it into pulses;

c. a standard oscillator for generating a series of standard clock pulses;

d. a preliminary measuring means adapted for operation by reception of the measured watch signal thereby determining one of predetermined measuring and displaying conditions; e) main measuring means for measurement of time error of said watch signal and depending upon the measuring conditions selected and determined by said preliminary measuring means; and f) time error display means for display of measured results by said main measuring means and depending upon the display condition selected and determined by said preliminary measuring means, said preliminary measuring means comprising a pulse generating circuit adapted for starting upon reception of said measured watch signal and for delivery of a plurality of gate signal pulses each comprising two or more seconds pulses plus or minus a measurable error time length and means for selecting and storing a gate signal pulse indicative of the shortest possible measuring range to thereby utilize one of the predetermined measuring conditions during the duration period of the selected gate signal pulse.

6. The apparatus of claim 5, wherein the gate signal pulse duration period corresponds to one of the predetermined measurement conditions.

7. The apparatus of claim 6, wherein said error display means comprises a plurality of digit display elements adapted in combination for representing multi-digit numbers, decimal point display means in combination with said digit display elements and means for variably positioning the decimal point in response to the duration period of selected-out gate signal pulse.

8. The apparatus of claim 7, wherein counters of said gate signal generation means and those of said time error measuring means are cooperable with one and the same counter circuit for execution of measuring condition setting operation and time error measuring operation in an alternating manner.

9. The apparatus of claim 8, wherein said watch signal sensing means comprises a plurality of sensing elements for selection of watch signals derived from different physical stepping modes of the watch, the sensing elements being connected in parallel with each other to signal processing means without intermediary of switching over means.

10. The apparatus of claim 9, wherein said signal processing means works with a predetermined preferential order depending upon the physical nature of input watch signal.

11. The apparatus of claim 10, wherein the preference is in the order of periodic information of electrical field, electromagnetic field and mechanical vibratory derived from the stepping operation of the watch under test.

* * * * *